US010546527B2

(12) United States Patent
Pyo et al.

(10) Patent No.: US 10,546,527 B2
(45) Date of Patent: Jan. 28, 2020

(54) DISPLAY DEVICE AND METHOD OF OPERATING THE SAME

(71) Applicant: Samsung Display Co., Ltd., Yongin-si, Gyeonggi-do (KR)

(72) Inventors: Si Beak Pyo, Yongin-si (KR); Seung Wook Nam, Yongin-si (KR); Jong Kwang Hwang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/164,182

(22) Filed: Oct. 18, 2018

(65) Prior Publication Data

US 2019/0130825 A1 May 2, 2019

(30) Foreign Application Priority Data

Oct. 31, 2017 (KR) ..... 10-2017-0144038

(51) Int. Cl.
*G09G 3/3225* (2016.01)

(52) U.S. Cl.
CPC ... *G09G 3/3225* (2013.01); *G09G 2320/0233* (2013.01)

(58) Field of Classification Search
CPC ..... G09G 2320/0233; G09G 2330/10
See application file for complete search history.

(56) References Cited

U.S. PATENT DOCUMENTS

2013/0176349 A1 7/2013 Park et al.
2015/0364089 A1 12/2015 Pyo et al.
2016/0005354 A1* 1/2016 Takasugi ..... G09G 3/3291 345/207
2016/0232876 A1* 8/2016 Kim ..... G09G 3/001
2017/0178583 A1* 6/2017 Zhang ..... G09G 3/3677
2017/0206842 A1 7/2017 An et al.
2018/0067356 A1* 3/2018 Katsuta ..... G02F 1/1345
2018/0129106 A1* 5/2018 Gao ..... G02F 1/134363
2018/0156964 A1* 6/2018 Song ..... G02B 6/0045
2018/0158417 A1* 6/2018 Xiang ..... G09G 3/3233
2018/0166018 A1* 6/2018 Yang ..... H01L 27/32
2019/0043418 A1* 2/2019 Rieutort-Louis .... G09G 3/3216
2019/0073962 A1* 3/2019 Aflatooni ..... G09G 3/3275
2019/0080648 A1* 3/2019 Hwang ..... G09G 3/3233
2019/0130807 A1* 5/2019 Wu ..... G11C 19/28

FOREIGN PATENT DOCUMENTS

CN 103198779 A 7/2013
KR 10-1376654 B1 3/2014
KR 10-2014-0086509 A 7/2014
KR 10-2017-0087558 A 7/2017

* cited by examiner

*Primary Examiner* — Dong Hui Liang
(74) *Attorney, Agent, or Firm* — Lewis Roca Rothgerber Christie LLP

(57) ABSTRACT

A display device includes first pixels positioned in a first pixel area, second pixels positioned in a second pixel area that has a different width from a width of the first pixel area, and a data compensating unit configured to compensate for image data. The data compensating unit sets a first compensation area and a second compensation area that is different from the first compensation area, and compensates for the image data corresponding to the first compensation area on a first block unit basis, and compensates for the image data corresponding to the second compensation area on a second block unit basis that is different from the first block unit basis, and the first compensation area includes the second pixel area.

19 Claims, 12 Drawing Sheets

DISPLAY DEVICE AND METHOD OF OPERATING THE SAME

CROSS-REFERENCE TO RELATED APPLICATION

This application claims priority to and the benefit of Korean Patent Application No. 10-2017-0144038, filed on Oct. 31, 2017, in the Korean Intellectual Property Office, the entire contents of which are incorporated herein by reference in their entirety.

BACKGROUND

1. Field

The present disclosure relates to a display device and a method of operating the same.

2. Description of the Related Art

As an information technology is developed, importance of a display device that is a connection medium between a user and information is being increased. Liquid crystal display (LCD) devices, organic light emitting display (OLED) devices, and the like are widely used.

The display device includes a plurality of pixels and drivers for driving the pixels. The drivers may be embedded in the display device, and in this case, the display device may have a dead space.

Each pixel includes a plurality of transistors that are connected by wires to the drivers. The wires may have load values of different degrees according to lengths, and an image of non-uniform brightness may be displayed by a difference in the load value.

SUMMARY

The present disclosure has been made in an effort to solve the above-described problems associated with the prior art, and provides a display device which is capable of solving a difference in brightness, and a method of operating the same.

The present disclosure has also been made in an effort to solve the above-described problems associated with the prior art, and provides a display device in which a dead space is efficiently usable.

An exemplary embodiment of the present disclosure provides a display device, including: first pixels positioned in a first pixel area and second pixels positioned in a second pixel area having a different width from a width of the first pixel area. A data compensating unit is configured to compensate for image data, in which the data compensating unit sets a first compensation area and a second compensation area that is different from the first compensation area, and compensates for the image data corresponding to the first compensation area on a first block unit basis, and compensates for the image data corresponding to the second compensation area on a second block unit basis that is different from the first block unit basis, and the first compensation area includes the second pixel area.

The width of the first pixel area may be larger than the width of the second pixel area.

The number of pixels included in the first block unit may be less than the number of pixels included in the second block unit.

The data compensating unit may further set a third compensation area that is different from the first compensation area and the second compensation area, and the third compensation area may be positioned between the first compensation area and the second compensation area.

The data compensating unit may compensate for the image data corresponding to the third compensation area on a third block unit basis, and the number of pixels included in the third block unit may be less than the number of pixels included in the second block unit and may be greater than the number of pixels included in the first block unit.

The number of pixels included in the first block unit may be one, the number of pixels included in the second block unit may be five or more, and the number of pixels included in the third block unit may be two or more and four or less.

The data compensating unit may detect a defective area in which at least one defective pixel is positioned based on a brightness image, and the first compensation area may further include the defective area.

The defective pixel may emit light having higher or lower brightness than brightness of a normal pixel when substantially the same data signal is supplied.

The data compensating unit may include: a defective area detector configured to generate defect information including information on position coordinates of the defective pixel based on the brightness image; a storing unit configured to store compensation information including information on position coordinates of the second pixels; and an area setting unit configured to set the first compensation area and the second compensation area based on the defect information and the compensation information, and generate area information about positions of the first compensation area and the second compensation area.

The data compensating unit may further include: a compensation data generator configured to generate compensation data based on the brightness image and the area information; and a compensator configured to compensate for the image data based on the compensation data.

The compensation data generator may include: a data separator configured to separate the brightness image into a first sub image corresponding to the first compensation area and a second sub image corresponding to the second compensation area based on the area information; a first sub generator configured to perform comparison processing on the first sub image on the first block unit basis to generate first sub data; a second sub generator configured to perform comparison processing on the second sub image on the second block unit basis to generate second sub data; and a data merging unit configured to merge the first sub data and the second sub data and generate the compensation data.

The second pixel area may be positioned at one side of the first pixel area.

The display device may further include third pixels positioned in a third pixel area having a different width from the width of the first pixel area, in which the second pixel area may be spaced apart from the third pixel area.

The first compensation area may entirely surround the second compensation area.

The first compensation area may partially surround the second compensation area.

Another exemplary embodiment of the present disclosure provides a method of operating a display device, which includes first pixels positioned in a first pixel area, second pixels positioned in a second pixel area having a different width from a width of the first pixel area, and a data compensating unit configured to compensate for image data, the method including: receiving the image data; setting a first compensation area and a second compensation area that is different from the first compensation area; compensating for the image data corresponding to the first compensation area on a first block unit basis; and compensating for the image data corresponding to the second compensation area on a second block unit basis that is different from the first block unit, in which the first compensation area includes the second pixel area.

The method may further include setting a third compensation area that is different from the first compensation area and the second compensation area, in which the third compensation area is positioned between the first compensation area and the second compensation area.

The method may further include compensating for the image data corresponding to the third compensation area on a third block unit basis, in which the number of pixels included in the third block unit is less than the number of pixels included in the second block unit and is greater than the number of pixels included in the first block unit.

The method may further include: receiving a brightness image; and detecting a defective area in which at least one defective pixel is positioned based on a brightness image, in which the first compensation area further includes the defective area.

According to the present disclosure, it is possible to provide the display device which is capable of displaying an image of uniform brightness by compensating for data in pixel areas having different widths based on different block units, and the method of operating the same.

Further, it is possible to provide the display device in which a dead space is efficiently usable, and the method of operating the same.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
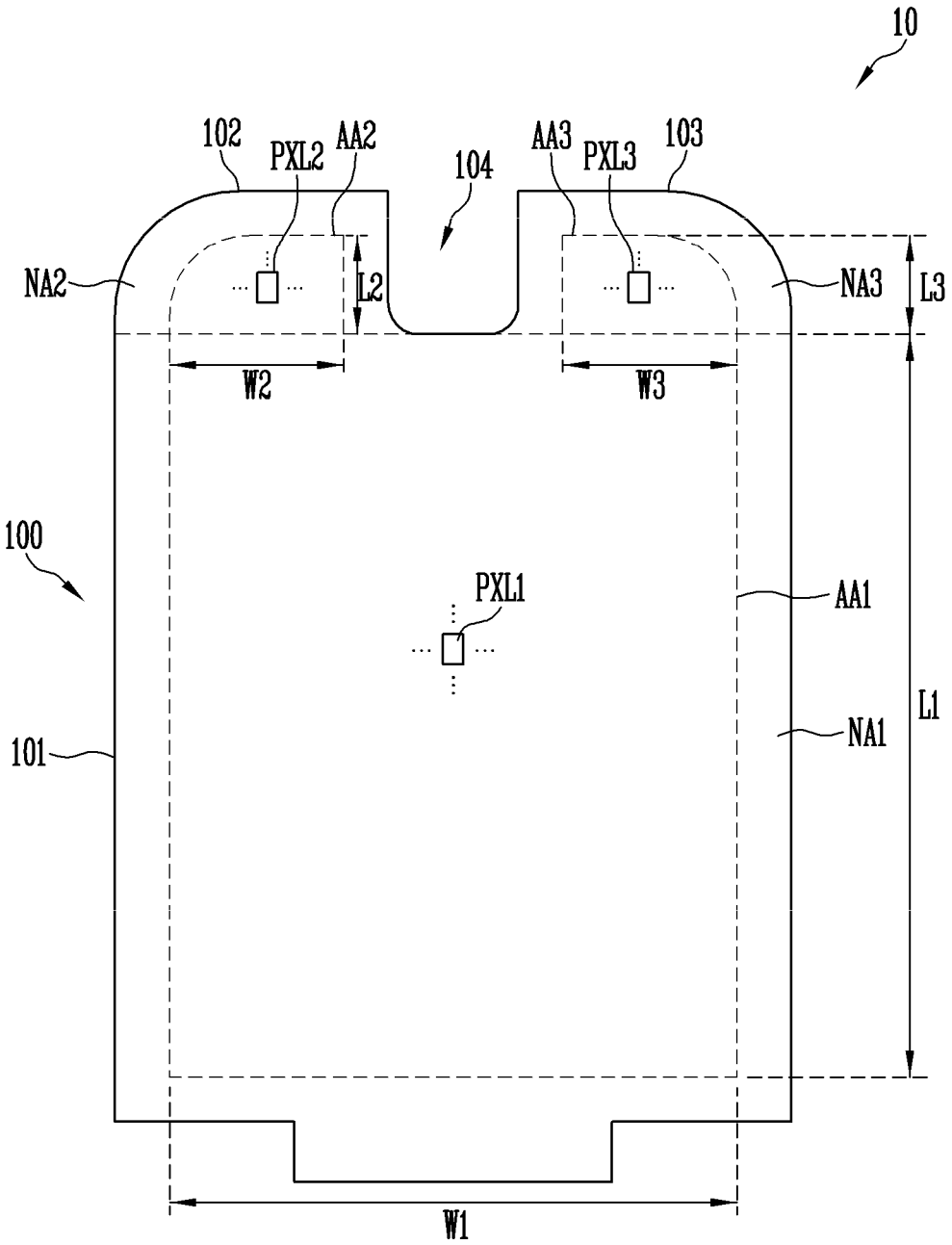
FIG. 1 is a diagram illustrating pixel areas of a display device according to an exemplary embodiment of the present disclosure.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a diagram illustrating pixel areas of a display device according to an exemplary embodiment of the present disclosure.

Referring to FIG. 1, according to an exemplary embodiment of the present disclosure a display device includes pixel areas AA1, AA2, and AA3, peripheral areas NA1, NA2, and NA3, and pixels PXL1, PXL2, and PXL3.

The plurality of pixels PXL1, PXL2, and PXL3 may be positioned in the pixel areas AA1, AA2, and AA3, and thus, an image (e.g., a predetermined image) may be displayed in the pixel areas AA1, AA2, and AA3. Accordingly, the pixel areas AA1, AA2, and AA3 may be referred to as display areas.

Constituent elements (for example, drivers and wires) for driving the pixels PXL1, PXL2, and PXL3 may be positioned in the peripheral areas NA1, NA2, and NA3. The pixels PXL1, PXL2, and PXL3 are not present in the peripheral areas NA1, NA2, and NA3, so that the peripheral areas NA1, NA2, and NA3 may be referred to as non-display areas.

For example, the peripheral areas NA1, NA2, and NA3 may be present at external sides of the pixel areas AA1, AA2, and AA3, and may have forms surrounding at least parts of the pixel areas AA1, AA2, and AA3.

The pixel areas AA1, AA2, and AA3 may include a first pixel area AA1, a second pixel area AA2, and a third pixel area AA3.

In some examples, the second pixel area AA2 and the third pixel area AA3 may be positioned at one side of the first pixel area AA1. In other examples, the second pixel area AA2 and the third pixel area AA3 may be positioned while being spaced apart from each other.

The first pixel area AA1 may have a larger area than those of the second pixel area AA2 and the third pixel area AA3.

For example, a width W1 of the first pixel area AA1 may be set to be larger than widths W2 and W3 of other pixel areas AA2 and AA3, and a length L1 of the first pixel area AA1 may be set to be larger than lengths L2 and L3 of other pixel areas AA2 and AA3.

Further, each of the second pixel area AA2 and the third pixel area AA3 may have a smaller area than that of the first pixel area AA1, and the second pixel area AA2 and the third pixel area AA3 may have the same area or different areas.

For example, the width W2 of the second pixel area AA2 may be set to be the same as or different from the width W3 of the third pixel area AA3, and the length L2 of the second pixel area AA2 may be set to be the same as or different from the length L3 of the third pixel area AA3.

The peripheral areas NA1, NA2, and NA3 may include a first peripheral area NA1, a second peripheral area NA2, and a third peripheral area NA3.

The first peripheral area NA1 may be located at the vicinity of the first pixel area AA1, and may have a form surrounding at least a part of the first pixel area AA1.

A width of the first peripheral area NA1 may be set to be generally the same. However, the width of the first peripheral area NA1 is not limited thereto, and may be differently set according to a position.

The second peripheral area NA2 may be located at the vicinity of the second pixel area AA2, and may have a form surrounding at least a part of the second pixel area AA2.

A width of the second peripheral area NA2 may be set to be generally the same. However, the width of the second peripheral area NA2 is not limited thereto, and may be differently set according to a position.

The third peripheral area NA3 may be located at an external side of the third pixel area AA3, and may surround at least a part of the third pixel area AA3.

A width of the third peripheral area NA3 may be set to be generally the same. However, the width of the third peripheral area NA3 is not limited thereto, and may be differently set according to a position.

The second peripheral area NA2 and the third peripheral area NA3 may be connected to each other or may not be connected with each other according to a form of a substrate 100.

The widths of the peripheral areas NA1, NA2, and NA3 may be generally the same. However, the widths of the peripheral areas NA1, NA2, and NA3 are not limited thereto, and may be differently set according to positions.

The pixels PXL1, PXL2, and PXL3 may include first pixels PXL1, second pixels PLX2, and third pixels PXL3.

For example, the first pixels PXL1 may be positioned in the first pixel area AA1, the second pixels PXL2 may be positioned in the second pixel area AA2, and the third pixels PXL3 may be positioned in the third pixel area AA3.

The pixels PXL1, PXL2, and PXL3 may include light emitting devices (for example, organic light emitting diodes) that emit light with a predetermined brightness under control of the drivers positioned in the peripheral areas NA1, NA2, and NA3.

The pixel areas AA1, AA2, and AA3 and the peripheral areas NA1, NA2, and NA3 may be defined on the substrate 100 of the display device 10.

The substrate 100 may be formed of an insulating material, such as glass and resin. Further, the substrate 100 may be formed of a material having flexibility to be bendable or foldable, and may have a single layer structure or a multilayer structure.

For example, the substrate 100 may include at least one of polystyrene, polyvinyl alcohol, polymethyl methacrylate, polyethersulfone, polyacrylate, polyetherimide, polyethylene naphthalate, polyethylene terephthalate, polyphenylene sulfide, polyarylate, polyimide, polycarbonate, triacetate cellulose, and cellulose acetate propionate.

The substrate 100 may be formed of various other materials. For example, the substrate 100 may also be formed of fiber glass reinforced plastic (FRP) and the like.

The substrate 100 may be formed in various forms in which the pixels areas AA1, AA2, and AA3 and the peripheral areas NA1, NA2, and NA3 may be set.

For example, the substrate 100 may include a plate-shaped base substrate 101, and a first auxiliary plate 102 and a second auxiliary plate 103 protruding and extended from one end portion of the base substrate 101.

The first auxiliary plate 102 and the second auxiliary plate 103 may be integrally formed with the base substrate 101, and a concave portion 104 may be present between the first auxiliary plate 102 and the second auxiliary plate 103.

The concave portion 104 may be formed by removing a part of the substrate 100, and the first auxiliary plate 102 and the second auxiliary plate 103 may be spaced apart from each other by the concave portion 104.

Each of the first auxiliary plate 102 and the second auxiliary plate 103 may have a smaller area than that of the base substrate 101, and the first auxiliary plate 102 and the second auxiliary plate 103 may have the same area or different areas.

The first auxiliary plate 102 and the second auxiliary plate 103 may be formed in various shapes in which the pixel areas AA2 and AA3 and the peripheral areas NA2 and NA3 may be set.

The first pixel area AA1 and the first peripheral area NA1 may be defined in the base substrate 101, the second pixel area AA2 and the second peripheral area NA2 may be defined in the first auxiliary substrate 102, and the third pixel area AA3 and the third peripheral area NA3 may be defined in the second auxiliary substrate 103.

The base substrate 101 may have various shapes. For example, the base substrate 101 may have a shape, such as a polygon and a circle. Further, at least a part of the base substrate 101 may have a curve shape.

For example, the base substrate 101 may have a quadrilateral (e.g. quadrangular) shape as illustrated in FIG. 1.

Otherwise, a corner portion of the base substrate 101 may be transformed to an inclined form or a curve form.

The base substrate 101 may have a form that is the same as or similar to that of the first pixel area AA1, but is not limited thereto, and may also have a form different from that of the first pixel area AA1.

The first auxiliary plate 102 and the second auxiliary plate 103 may also have various shapes.

For example, the first auxiliary plate 102 and the second auxiliary plate 103 may have a polygon or a circle shape. Further, at least a part of the first auxiliary plate 102 and the second auxiliary plate 103 may have a curve shape.

The concave portion 104 may have various shapes. For example, the concave portion 104 may have any shape, such as a polygon or a circle. Further, at least a part of the concave portion 104 may have a curve shape.

The first pixel area AA1 to the third pixel area AA3 may have various shapes. For example, each of the first pixel area AA1 to the third pixel area AA3 may have a a polygon or a circle shape.

FIG. 1 illustrates the case where the first pixel area AA1 has the rectangular (e.g. quadrangular) shape as an example. However, the present disclosure is not limited thereto. For example, at least a part of the first pixel area AA1 may have a curve shape, and a corner portion of the first pixel area AA1 may have a curve shape having a predetermined curvature.

Further, FIG. 1 illustrates the case where at least the part of each of the second pixel area AA2 and the third pixel area AA3, may, for example, have a curved shape. However, the present disclosure is not limited thereto, and the second pixel area AA2 and the third pixel area AA3 may also have quadrilateral (e.g. quadrangular) shapes.

In this case, the second peripheral area NA2 may have at least a part shaped like a curve so as to correspond to the second pixel area AA2.

The number of second pixels PXL2 positioned in one line (row or column) may be changed according to the position thereof in response to a change in the form of the second pixel area AA2.

Further, the third peripheral area NA3 may have at least a part shaped like a curve so as to correspond to the third pixel area AA3.

The number of third pixels PXL3 positioned in one line (row or column) may be changed according to the position thereof in response to a change in the form of the third pixel area AA3.

Figure 2:
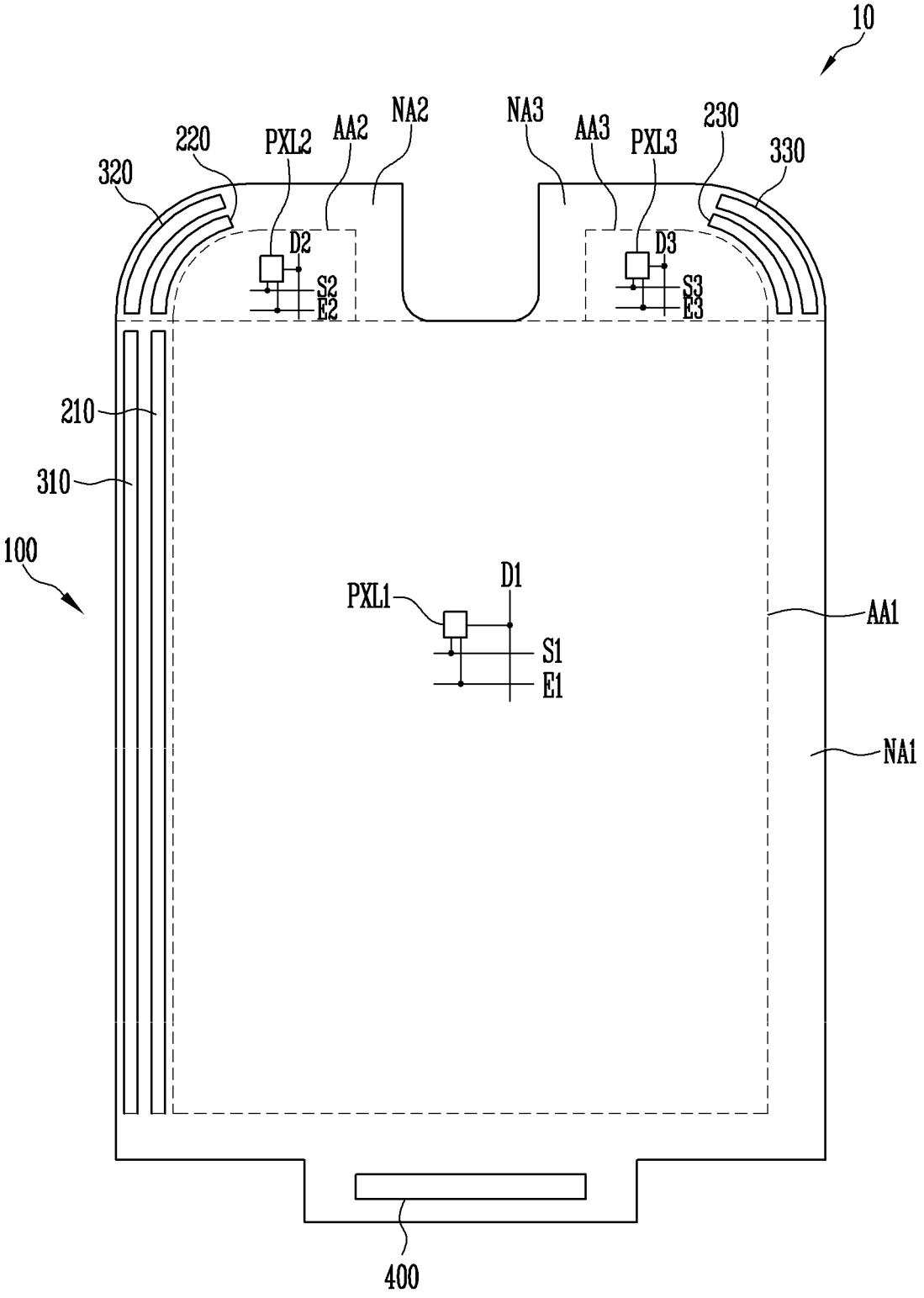
FIG. 2 is a diagram illustrating the display device according to the exemplary embodiment of the present disclosure.

FIG. 2 is a diagram illustrating the display device according to the exemplary embodiment of the present disclosure.

Referring to FIG. 2, the display device 10 according to the exemplary embodiment of the present disclosure may include the substrate 100, the first pixels PXL1, the second pixels PXL2, the third pixels PXL3, a first scan driver 210, a second scan driver 220, a third scan driver 230, a first emission driver 310, a second emission driver 320, and a third emission driver 330.

Each of the first pixels PXL1 may be positioned in the first pixel area AA1, and may be connected with a first scan line S1, a first emission control line E1, and a first data line D1.

The first scan driver 210 may supply a first scan signal to the first pixels PXL1 through the first scan lines S1.

For example, the first scan driver 210 may sequentially supply the first scan signal to the first scan lines S1.

The first scan driver 210 may be positioned in the first peripheral area NA1.

For example, the first scan driver 210 may be positioned in the first peripheral area NA1 present at one side (for example, a left side based on FIG. 2) of the first pixel area AA1.

First scan routing wires R1 may be connected between the first scan driver 210 and the first scan lines S1.

Accordingly, the first scan driver 210 may be electrically connected with the first scan lines S1 positioned in the first pixel area AA1 through the first scan routing wires R1.

The first emission driver 310 may supply a first emission control signal to the first pixels PXL1 through the first emission control lines E1.

For example, the first emission driver 310 may sequentially supply the first emission control signal to the first emission control lines E1.

The first emission driver 310 may be positioned in the first peripheral area NA1.

For example, the first emission driver 310 may be positioned in the first peripheral area NA1 present at one side (for example, the left side based on FIG. 2) of the first pixel area AA1.

FIG. 2 illustrates the case where the first emission driver 310 is positioned at the external side of the first scan driver 210, but in contrast to this, the first emission driver 310 may also be positioned at the internal side of the first scan driver 210.

First emission routing wires (not illustrated) may be connected between the first emission driver 310 and the first emission control lines E1.

Accordingly, the first emission driver 310 may be electrically connected with the first emission control lines E1 positioned in the first pixel area AA1 through the first emission routing wires (not illustrated).

In some examples, the first pixels PXL1 may have structures where it is not necessary to use the first emission control signal. In these examples, the first emission driver 310, the first emission routing wires (not illustrated), and the first emission control lines E1 may be omitted.

FIG. 2 illustrates the case where the first scan driver 210 and the first emission driver 310 are disposed at the left side of the first pixel area AA1, but the present disclosure is not limited thereto. For example, the first scan driver 210 and the first emission driver 310 may be disposed at the right side of the first pixel area AA1, or may be disposed at the left side and the right side of the first pixel area AA1.

Each of the second pixels PXL2 may be positioned in the second pixel area AA2, and may be connected with a second scan line S2, a second emission control line E2, and a second data line D2.

The second scan driver 220 may supply a second scan signal to the second pixels PXL2 through the second scan lines S2.

For example, the second scan driver 220 may sequentially supply the second scan signal to the second scan line S2.

The second scan driver 220 may be positioned in the second peripheral area NA2.

For example, the second scan driver 220 may be positioned in the second peripheral area NA2 present at one side (for example, the left side based on FIG. 2) of the second pixel area AA2.

Second scan routing wires R1 may be connected between the second scan driver 220 and the second scan lines S2.

Accordingly, the second scan driver 220 may be electrically connected with the second scan lines S2 positioned in the second pixel area AA2 through the second scan routing wires (not illustrated).

The second emission driver 320 may supply a second emission control signal to the second pixels PXL2 through the second emission control lines E2.

For example, the second emission driver 320 may sequentially supply the second emission control signal to the second emission control lines E2.

The second emission driver 320 may be positioned in the second peripheral area NA2.

For example, the second emission driver 320 may be positioned in the second peripheral area NA2 present at one side (for example, the left side based on FIG. 2) of the second pixel area AA2.

FIG. 2 illustrates the case where the second emission driver 320 is positioned at the external side of the second emission driver 320, but in contrast to this, the second emission driver 320 may also be positioned at the internal side of the second scan driver 220.

Second emission routing wires (not illustrated) may be connected between the second emission driver 320 and the second emission control lines E2.

Accordingly, the second emission driver 320 may be electrically connected with the second emission control lines E2 positioned in the second pixel area AA2 through the second emission routing wires (not illustrated).

In some examples, the second pixels PXL2 may have structures where it is not necessary to use the second emission control signal. In these examples, the second emission driver 320, the second emission routing wires (not illustrated), and the second emission control lines E2 may be omitted.

The second pixel area AA2 has a smaller area than that of the first pixel area AA1. Thus, the lengths of the second scan line S2 and the second emission control line E2 may be smaller than lengths of the first scan line S1 and the first emission control line E1.

Further, the number of second pixels PXL2 connected to a second scan line S2 may be less than the number of first pixels PXL1 connected to a first scan line S1, and the number of second pixels PXL2 connected to one second emission control line E2 may be less than the number of first pixels PXL1 connected to one first emission control line E1.

Each of the third pixels PXL3 may be positioned in the third pixel area AA3, and may be connected with a third scan line S3, a third emission control line E3, and a third data line D3.

The third scan driver 230 may supply a third scan signal to the third pixels PXL3 through the third scan lines S3.

For example, the third scan driver 230 may sequentially supply the third scan signal to the third scan lines S3.

The third scan driver 230 may be positioned in the third peripheral area NA3.

For example, the third scan driver 230 may be positioned in the third peripheral area NA3 present at one side (for example, a right side based on FIG. 2) of the third pixel area AA3.

Third scan routing wires (not illustrated) may be connected between the third scan driver 310 and the third scan lines S3.

Accordingly, the third scan driver 230 may be electrically connected with the third scan lines S3 positioned in the third pixel area AA3 through the third scan routing wires (not illustrated).

The third emission driver 330 may supply a third emission control signal to the third pixels PXL3 through the third emission control lines E3.

For example, the third emission driver 330 may sequentially supply the third emission control signal to the third emission control lines E3.

The third emission driver 330 may be positioned in the third peripheral area NA3.

For example, the third emission driver 330 may be positioned in the third peripheral area NA3 present at one side (for example, the right side based on FIG. 2) of the third pixel area AA3.

FIG. 2 illustrates the case where the third emission driver 330 is positioned at the external side of the third scan driver 230, but in contrast to this, the third emission driver 330 may also be positioned at the internal side of the third scan driver 230.

Third emission routing wires (not illustrated) may be connected between the third emission driver 330 and the third emission control lines E3.

Accordingly, the third emission driver 330 may be electrically connected with the third emission control lines E3 positioned in the third pixel area AA3 through the third emission routing wires R6.

In some examples, the third pixels PXL3 have structures where it is not necessary to use the third emission control signal. In these examples, the third emission driver 330, the third emission routing wires (not illustrated), and the third emission control lines E3 may be omitted.

The third pixel area AA3 has a smaller area than that of the first pixel area AA1, thus the lengths of the third scan line S3 and the third emission control line E3 may be less than lengths of the first scan line S1 and the first emission control line E1.

Further, the number of third pixels PXL3 connected to a third scan line S3 may be less than the number of first pixels PXL1 connected to a first scan line S1, and the number of third pixels PXL3 connected to one third emission control line E3 may be less than the number of first pixels PXL1 connected to one first emission control line E1.

The emission control signal is used for controlling emission time of the pixels PXL1, PXL2, and PXL3. To this end, the emission control signal may be set to have a larger width than that of the scan signal.

For example, the emission control signal may be set with a gate off voltage (for example, a voltage of a high level) so that the transistors included in the pixels PXL1, PXL2, and PXL3 may be turned off, and the scan signal may be set with a gate on voltage (for example, a voltage of a low level) so that the transistors included in the pixels PXL1, PXL2, and PXL3 may be turned on.

The data driver 400 may supply a data signal to the pixels PXL1, PXL2, and PXL3 through the data lines D1, D2, and D3. For example, the second data lines D2 may be connected to some of the first data lines D1, and the third data lines D3 may be connected to the other of the first data lines D1.

The data driver 400 may be positioned in the first peripheral area NA1, and may be present at a position that does not overlap the first scan driver 210. For example, the data driver 400 may be positioned in the first peripheral area NA1 present at a lower side of the first pixel area AA1.

The data driver 400 may be provided by various schemes, such as chip on glass, chip on plastic, tape carrier package, and chip on film.

For example, the data driver 400 may be directly mounted on the substrate 100, or may be connected with the substrate 100 through a separate constituent element (for example, a flexible printed circuit board).

Although not illustrated in FIG. 2, the display device 10 may further include a timing controller which provides a predetermined control signal to the scan drivers 210, 220, and 230, the emission drivers 310, 320, and 330, and the data driver 400.

Figure 3:
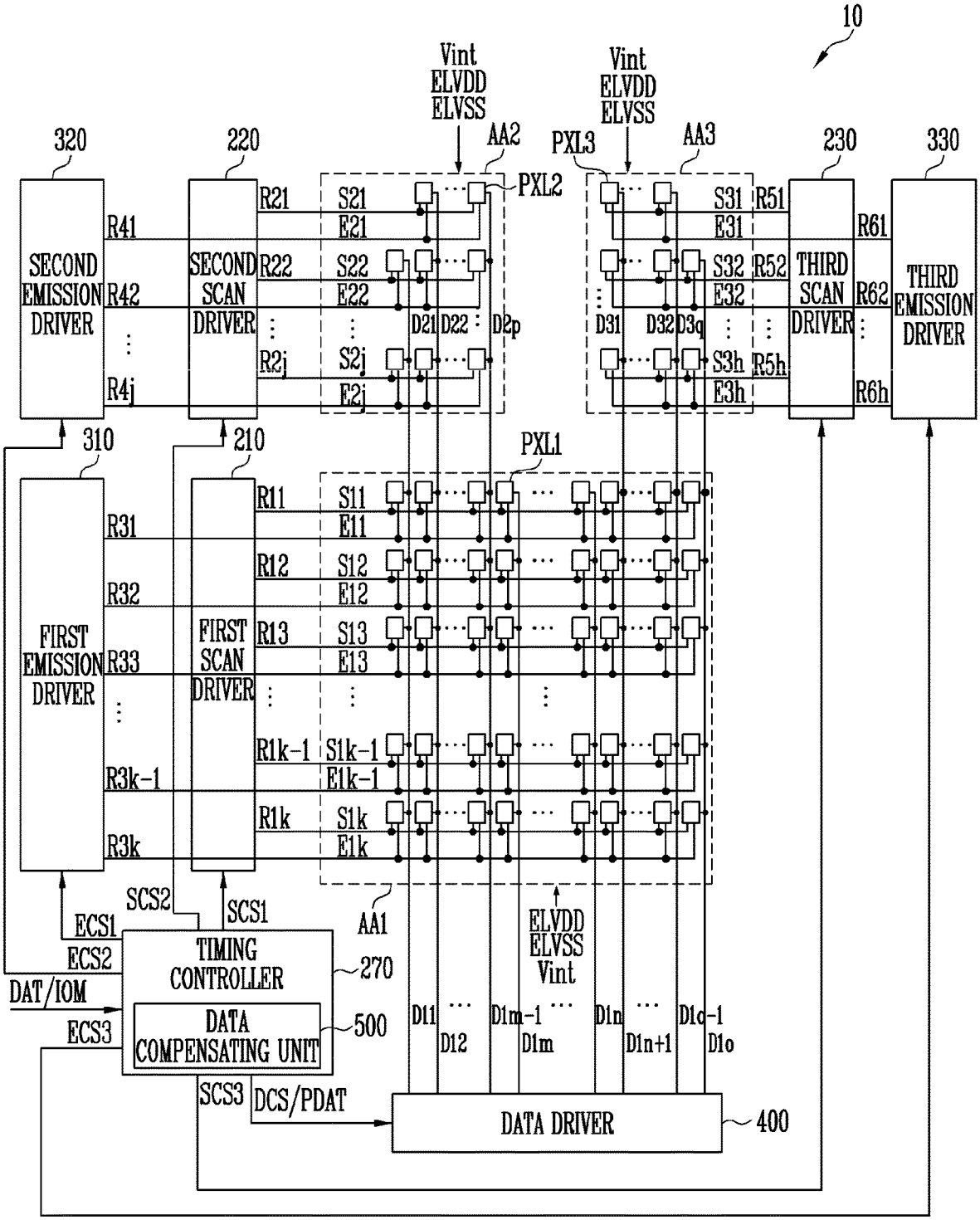
FIG. 3 is a diagram illustrating a configuration of the display device according to the exemplary embodiment of the present disclosure in detail.

FIG. 3 is a diagram illustrating a configuration of the display device according to the exemplary embodiment of the present disclosure in detail.

Referring to FIG. 3, the first scan driver 210 may supply the first scan signal to the first pixels PXL1 through first scan routing wires R11 to R1*k* and the first scan lines S11 to S1*k*.

The first scan routing wires R11 to R1*k* may be connected between an output terminal of the first scan driver 210 and the first scan lines S11 to S1*k*.

For example, the first scan routing wires R11 to R1*k* and the first scan lines S11 to S1*k* may be positioned on different layers, and in this case, the first scan routing wires R11 to R1*k* may be connected with the first scan lines S11 to S1*k* through contact holes (not illustrated).

Otherwise, the first scan routing wires R11 to R1*k* and the first scan lines S11 to S1*k* may be integrally formed on the same layer. That is, the first scan routing wires R11 to R1*k* may be some of the first scan lines S11 to S1*k*.

The first emission driver 310 may supply the first emission control signal to the first pixels PXL1 through first emission routing wires R31 to R3*k* and the first emission control lines E11 to E1*k*.

The first emission routing wires R31 to R3*k* may be connected between an output terminal of the first emission driver 310 and the first emission control lines E11 to E1*k*.

For example, the first emission routing wires R31 to R3*k* and the first emission control lines E11 to E1*k* may be positioned on different layers, and in this case, the first emission routing wires R31 to R3*k* may be connected with the first emission control lines E11 to E1*k* through contact holes (not illustrated).

Otherwise, the first emission routing wires R31 to R3*k* and the first emission control lines E11 to E1*k* may be integrally formed on the same layer. That is, the first emission routing wires R31 to R3*k* may be some of the first emission control lines E11 to E1*k*.

The first scan driver 210 and the first emission driver 310 may operate in response to a first scan control signal SCS1 and a first emission control signal ECS1, respectively.

The data driver 400 may supply a data signal to the first pixels PXL1 through first data lines D11 to D1*o*.

The first pixels PXL1 may be connected to a first pixel power source ELVDD and a second pixel power source ELVSS. The first pixels PXL1 may be additionally connected to a third pixel power source Vint as necessary.

When the first scan signal is supplied to the first scan lines S11 to S1*k*, the first pixels PXL1 may receive the data signal from the first data lines D11 to D1*o*, and the first pixels PXL1 receiving the data signal may control the amount of current flowing from the first pixel power source ELVDD to the second pixel power source ELVSS through an organic light emitting diode (not illustrated).

The second scan driver 220 may supply the second scan signal to the second pixels PXL2 through second scan routing wires R21 to R2*j* and second scan lines S21 to S2*j*.

The second scan routing wires R21 to R2*j* may be connected between an output terminal of the second scan driver 220 and the second scan lines S21 to S2*j*.

For example, the second scan routing wires R21 to R2*j* and the second scan lines S21 to S2*j* may be positioned on different layers, and in this case, the second scan routing wires R21 to R2*j* may be connected with the second scan lines S21 to S2*j* through contact holes (not illustrated).

Otherwise, the second scan routing wires R21 to R2*j* and the second scan lines S21 to S2*j* may also be integrally formed on the same layer. In this case, the second scan routing wires R21 to R2*j* may be some of the second scan lines S21 to S2*j*.

The second emission driver 320 may supply the second emission control signal to the second pixels PXL2 through second emission routing wires R41 to R4*j* and the second emission control lines E21 to E2*j*.

The second emission routing wires R41 to R4*j* may be connected between an output terminal of the second emission driver 320 and the second emission control lines E21 to E2*j*.

For example, the second emission routing wires R41 to R4*j* and the second emission control lines E21 to E2*j* may be positioned on different layers, and in this case, the second emission routing wires R41 to R4*j* may be connected with the second emission control lines E21 to E2*j* through contact holes (not illustrated).

Otherwise, the second emission routing wires R41 to R4*j* and the second emission control lines E21 to E2*j* may be positioned on the same layer, and in this case, the second emission routing wires R41 to R4*j* may be some of the second emission control lines E21 to E2*j*.

The second scan driver 220 and the second emission driver 320 may operate in response to a second scan control signal SCS2 and a second emission control signal ECS2, respectively.

The data driver 400 may supply a data signal to the second pixels PXL2 through second data lines D21 to D2*p*.

For example, the second data lines D21 to D2*p* may be connected with some of the first data lines D11 to D1*m*−1.

Further, the second pixels PXL2 may be connected to the first pixel power source ELVDD and the second pixel power source ELVSS. The second pixels PXL2 may be additionally connected to the third pixel power source Vint as necessary.

When the second scan signal is supplied to the second scan lines S21 to S2*j*, the second pixels PXL2 may receive the data signal from the second data lines D21 to D2*p*, and the second pixels PXL2 receiving the data signal may control the amount of current flowing from the first pixel power source ELVDD to the second pixel power source ELVSS through an organic light emitting diode (not illustrated).

Further, the number of second pixels PXL2 positioned in one line (row or column) may be changed according to positions thereof.

The second pixel area AA2 has a smaller area than that of the first pixel area AA1, thus the number of second pixels PXL2 may be less than the number of first pixels PXL1, and the lengths and the numbers of the second scan lines S21 to S2*j* and the second emission control lines E21 to E2*j* may be less than the lengths and the numbers of the first scan lines S11 to S1*k* and the first emission control lines E11 to E1*k*, respectively.

The number of second pixels PXL2 connected to any one of the second scan lines S21 to S2*j* may be less than the number of first pixels PXL1 connected to any one of the first scan lines S11 to S1*k*.

Further, the number of second pixels PXL2 connected to any one of the second emission control lines E21 to E2*j* may be less than the number of first pixels PXL1 connected to any one of the first emission control lines E11 to E1*k*.

The third scan driver 230 may supply the third scan signal to the third pixels PXL3 through third scan routing wires R51 to R5*j* and third scan lines S31 to S3*h*.

The third scan routing wires R51 to R5*h* may be connected between an output terminal of the third scan driver 230 and the third scan lines S31 to S3*h*.

For example, the third scan routing wires R51 to R5*h* and the third scan lines S31 to S3*h* may be positioned on different layers, and in this case, the third scan routing wires R51 to R5*h* may be connected with the third scan lines S31 to S3*h* through contact holes (not illustrated).

In some examples, the third scan routing wires R51 to R5*h* and the third scan lines S31 to S3*h* may also be integrally formed on the same layer. In this case, the third scan routing wires R51 to R5*h* may be some of the third scan lines S31 to S3*h*.

The third scan driver 230 may operate in response to a third scan control signal SCS3.

The third emission driver 330 may supply the third emission control signal to the third pixels PXL3 through third emission routing wires R61 to R6*h* and the third emission control lines E31 to E3*h*.

The third emission routing wires R61 to R6*h* may be connected between an output terminal of the third emission driver 330 and the third emission control lines E31 to E3*h*.

For example, the third emission routing wires R61 to R6*h* and the third emission control lines E31 to E3*h* may be positioned on different layers, and in this case, the third emission routing wires R61 to R6*h* may be connected with the third emission control lines E31 to E3*h* through contact holes (not illustrated).

In some examples, the third emission routing wires R61 to R6*h* and the third emission control lines E31 to E3*h* may be integrally formed on the same layer, and in this case, the third emission routing wires R61 to R6*h* may be some of the third emission control lines E31 to E3*h*.

The third emission driver 330 may operate in response to a third emission control signal ECS3.

The data driver 400 may supply a data signal to the third pixels PXL3 through third data lines D31 to D3*q*.

The third data lines D31 to D3*q* may be connected with some of the first data lines D1*n*+1 to D1*o*.

The third pixels PXL3 may be connected to the first pixel power source ELVDD and the second pixel power source ELVSS. The third pixels PXL3 may be additionally connected to the third pixel power source Vint as necessary.

When the third scan signal is supplied to the third scan lines S31 to S3*h*, the third pixels PXL3 may receive the data signal from the third data lines D31 to D3*q*, and the third pixels PXL3 receiving the data signal may control the amount of current flowing from the first pixel power source ELVDD to the second pixel power source ELVSS through an organic light emitting diode (not illustrated).

Further, the number of third pixels PXL3 positioned in one line (row or column) may be changed according to positions thereof.

The third pixel area AA3 has a smaller area than that of the first pixel area AA1, thus the number of third pixels PXL3 may be less than the number of first pixels PXL1, and the lengths of the third scan lines S31 to S3*h* and the third emission control lines E31 to E3*h* may be less than the lengths of the first scan lines S11 to S1*k* and the first emission control lines E11 to E1*k*.

The number of third pixels PXL3 connected to any one of the third scan lines S31 to S3*h* may be less than the number of first pixels PXL1 connected to any one of the first scan lines S11 to S1*k*.

Further, the number of third pixels PXL3 connected to any one of the third emission control lines E31 to E3*h* may be less than the number of first pixels PXL1 connected to any one of the first emission control lines E11 to E1*k*.

The data driver 400 may operate in response to a data control signal DCS. Further, the data driver 400 may receive pixel data PDAT.

The data driver 400 may supply the data signal to the pixels PXL1, PXL2, PXL3 through the first data lines D11 to D1*o*, the second data lines D21 to D2*p*, and the third data lines D31 to D3*q* based on the pixel data PDAT.

The timing controller 270 may control the first scan driver 210, the second scan driver 220, the third scan driver 230, the data driver 400, the first emission driver 310, the second emission driver 320, and the third emission driver 330.

To this end, the timing controller 270 may supply the first scan control signal SCS1, the second scan control signal SCS2, and the third scan control signal SCS3 to the first scan driver 210, the second scan driver 220, and the third scan driver 230, respectively, and may supply the first emission control signal ECS1, the second emission control signal ECS2, and the third emission control signal ECS3 to the first emission driver 310, the second emission driver 320, and the third emission driver 330, respectively.

In this case, each of the scan control signals SCS1, SCS2, and SCS3 and the emission control signals ECS1, ECS2, and ECS3 may include at least one clock signal and start pulse.

The start pulse may control timing of the first scan signal or the first emission control signal. The clock signal may be used for shifting a start pulse.

The timing controller 270 may supply the data control signal DCS to the data driver 400.

A source start pulse and at least one clock signal may be included in the data control signal DCS. The source start pulse may control a sampling start time of data, and the clock signal may be used for controlling a sampling operation.

Further, the timing controller 270 may include a data compensating unit 500. However, the present disclosure is not limited thereto, and the data compensating unit 500 may be a separate configuration from the timing controller 270.

The data compensating unit 500 may receive a brightness image OIM obtained from an external photographing camera (not illustrated). For example, the brightness image OIM may be obtained by photographing, by the external photographing camera (not illustrated), the pixel areas AA1, AA2, and AA3 displaying a basic image.

The data compensating unit 500 may receive image data DAT. For example, the data compensating unit 500 may receive the image data DAT from a communication unit or a memory.

The data compensating unit 500 may generate pixel data PDAT by compensating for the image data DAT by using the brightness image OIM.

According to the embodiment, the data compensating unit 500 may set a first compensation area and a second compensation area. The second compensation area may be different from the first compensation area.

The data compensating unit 500 may compensate for the image data DAT corresponding to the first compensation area on the first block unit basis, and may compensate for the image data DAT corresponding to the second compensation area on the second block unit basis. The second block unit may be different from the first block unit.

In this case, the first compensation area may include at least one of the second pixel area AA2 and the third pixel area AA3.

The number of pixels included in the first block unit may be less than the number of pixels included in the second block unit.

According to the exemplary embodiment, the data compensating unit 500 may set a first compensation area, a second compensation area, and a third compensation area. The second compensation area may be different from the first compensation area, and the third compensation area may be positioned between the first compensation area and the second compensation area.

The data compensating unit 500 may compensate for the image data DAT corresponding to the first compensation area in the first block unit basis, compensate for the image data DAT corresponding to the second compensation area in the second block unit basis, and compensate for the image data DAT corresponding to the third compensation area in the third block unit basis. The second block unit may be different from the first block unit.

In this case, the first compensation area may include at least one of the second pixel area AA2 and the third pixel area AA3.

The number of pixels included in the first block unit may be less than the number of pixels included in the second block unit.

The number of pixels included in the third block unit may be greater than the number of pixels included in the first block unit, and may be less than the number of pixels included in the second block unit.

For example, the number of pixels included in the first block unit may be one, the number of pixels included in the second block unit may be five or more, and the number of pixels included in the third block unit may be two or more and four or less. However, the present disclosure is not limited thereto.

According to the exemplary embodiment, the data compensating unit 500 may detect a defective area in which at least one defective pixel is positioned based on the brightness image OIM. In this case, the data compensating unit 500 may set a first compensating area further including a defective area.

A defective pixel may be a pixel emitting light having higher or lower brightness than that of a normal pixel when substantially the same data signal is supplied.

Detailed contents related to the data compensating unit 500 will be given with reference to FIG. 5.

Figure 4A:
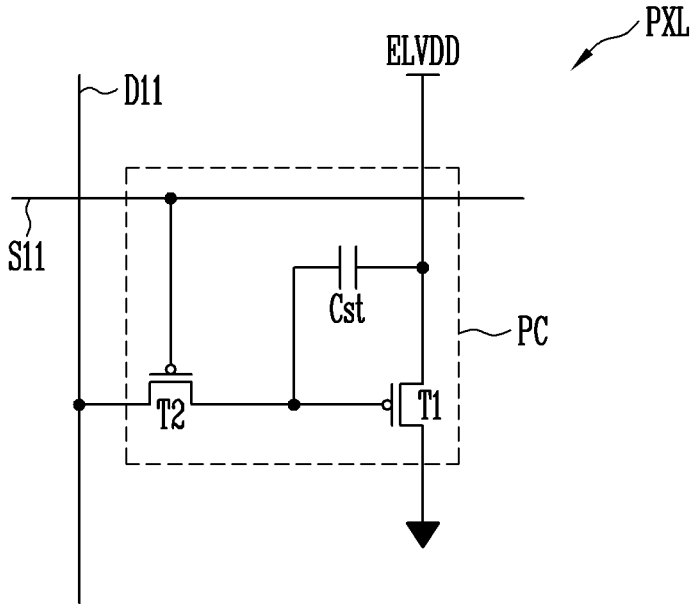
FIG. 4A is a circuit diagram illustrating a pixel according to the exemplary embodiment of the present disclosure.
Figure 4B:
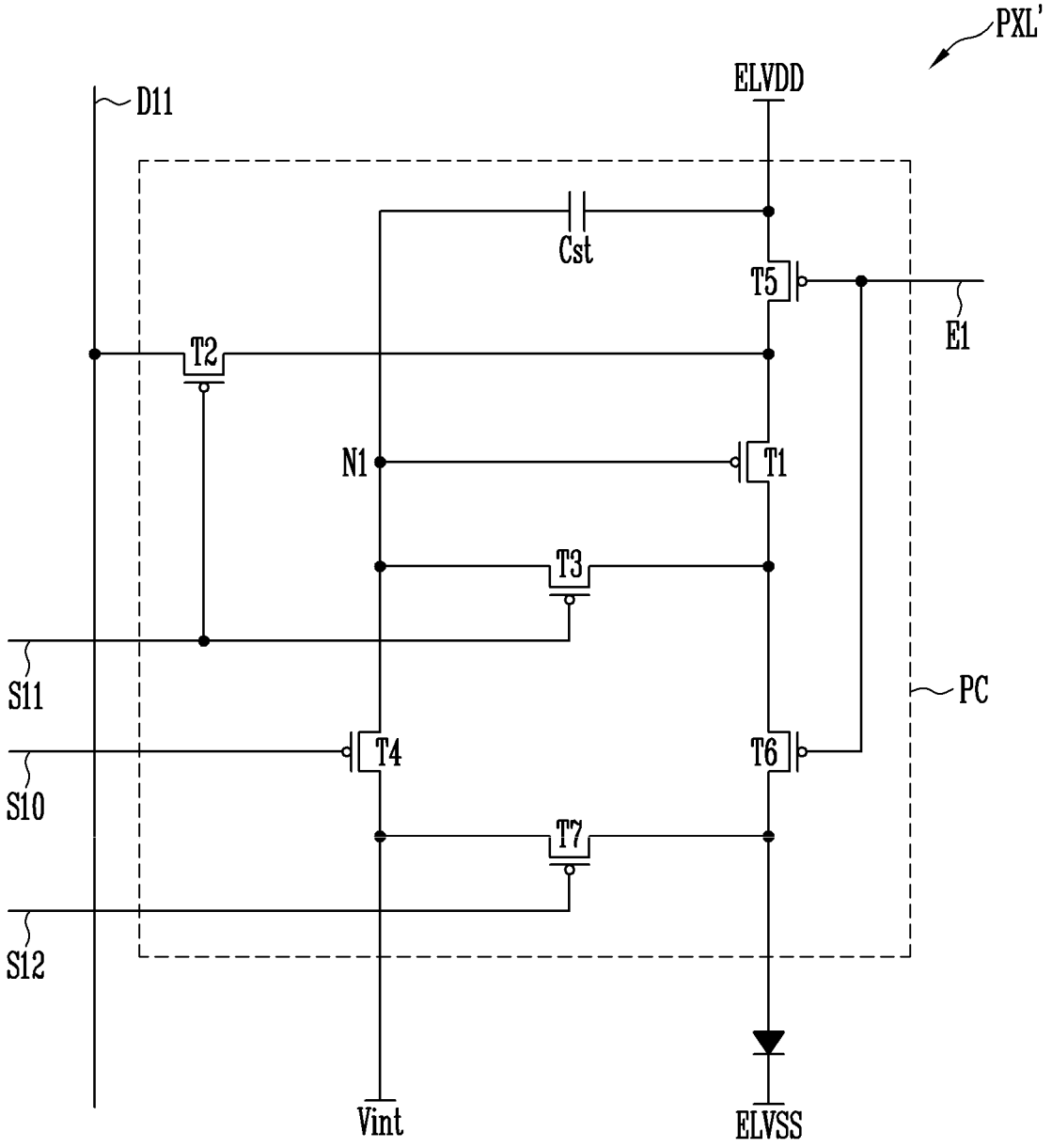
FIG. 4B is a circuit diagram illustrating a pixel according to another exemplary embodiment of the present disclosure.

FIGS. 4A and 4B are diagrams illustrating the pixel according to the exemplary embodiment of the present disclosure For convenience of the description, FIGS. 4A and 4B illustrate pixels PXL and PXL' connected to any one S11 among the first scan lines and any one D11 among the first data lines. The description below may be applied to other pixels illustrated in FIG. 3. Further, FIGS. 4A and 4B illustrate the case where light emitting devices of the pixels PXL and PXL' are organic light emitting diodes OLEDs.

First, referring to FIG. 4A, the pixel PXL may include an organic light emitting diode OLED, and a pixel circuit PC connected to the first data line D1 and the first scan line S11 to control the organic light emitting diode OLED.

An anode electrode of the organic light emitting diode OLED may be connected to the pixel circuit PC, and a cathode electrode thereof may be connected to the second pixel power source ELVSS.

The OLD may generate light having predetermined brightness in response to a current supplied from the pixel circuit PC.

The pixel circuit PC may store a data signal supplied to the first data line D11 when a scan signal is supplied to the first scan line S11, and may control the amount of current supplied to the organic light emitting diode OLED in response to the stored data signal.

For example, the pixel circuit PC may include a first transistor T1, a second transistor T2, and a storage capacitor Cst.

The first transistor T1 may be connected between the first pixel power source ELVDD and the organic light emitting diode OLED.

For example, in the first transistor T1, a gate electrode may be connected to a first electrode of the storage capacitor Cst and a second electrode of the second transistor T2, a first electrode may be connected to a second electrode of the storage capacitor Cst and the first pixel power source ELVDD, and a second electrode may be connected to the anode electrode of the organic light emitting diode OLED.

The first transistor T1 may control, as a driving transistor, the amount of current flowing from the first pixel power source ELVDD to the second pixel power source ELVSS via the organic light emitting diode OLED in response to a voltage value stored in the storage capacitor Cst.

In this case, the organic light emitting diode OLED may generate light corresponding to the amount of current supplied from the first transistor T1.

The second transistor T2 may be connected between the first data line D11 and the first transistor T1.

For example, in the second transistor T2, a gate electrode may be connected to the first scan line S11, a first electrode may be connected to the first data line D11, and a second electrode may be connected to the gate electrode of the first transistor T1.

The second transistor T2 is turned on when the scan signal is supplied from the first scan line S11, thereby supplying the data signal from the first data line D11 to the storage capacitor Cst.

In this case, the storage capacitor Cst may charge a voltage corresponding to the data signal.

Herein, the first electrode of each of the transistors T1 and T2 may be set to any one of a source electrode and a drain electrode, and the second electrode of each of the transistors T1 and T2 may be set to an electrode different from the first electrode. For example, when the first electrode is set to a source electrode, the second electrode may be set to a drain electrode.

Further, FIG. 4A illustrates that the transistors T1 and T2 are PMOS transistors as an example, but in another exemplary embodiment, the transistors T1 and T2 may be implemented by NMOS transistors.

Referring to FIG. 4B, the PXL according to another exemplary embodiment of the present disclosure may include an organic light emitting diode OLED and a pixel circuit PC for controlling the organic light emitting diode OLED.

An anode electrode of the organic light emitting diode OLED may be connected to the pixel circuit PC, and a cathode electrode thereof may be connected to the second pixel power source ELVSS.

The pixel circuit PC may include a first transistor T1 to a seventh transistor T7, and a storage capacitor Cst.

The anode electrode of the organic light emitting diode OLED may be connected to the first transistor T1 via the sixth transistor T6, and the cathode electrode thereof may be connected to the second pixel power source ELVSS. The organic light emitting diode OLED may generate light corresponding to the amount of current supplied from the first transistor T1.

A first pixel power source ELVDD may be set with a higher voltage than that of the second power source so that a current may flow to the organic light emitting diode OLED.

The seventh transistor T7 may be connected between a third pixel power source Vint and the anode electrode of the organic light emitting diode OLED. Further, a gate electrode of the seventh transistor T7 may be connected to a scan line S12. The seventh transistor T7 is turned on when a scan signal is supplied to the scan line S12, thereby supplying the voltage of the third pixel power source Vint to the anode electrode of the organic light emitting diode OLED. Herein, the third pixel power source Vint may be set with a lower voltage than that of the data signal.

The sixth transistor T6 may be connected between the first transistor T1 and the organic light emitting diode OLED. Further, a gate electrode of the sixth transistor T6 may be connected to a first emission control line Ep. The sixth transistor T6 may be turned off when an emission control signal is supplied to the first emission control line Ep, and may be turned on in other cases.

The fifth transistor T5 may be connected between the first pixel power source ELVDD and the first transistor T1. Further, a gate electrode of the fifth transistor T5 may be connected to the first emission control line Ep. The fifth transistor T5 may be turned off when the emission control signal is supplied to the first emission control line Ep, and may be turned on in other cases.

A first electrode of the first transistor T1 (the driving transistor) may be connected to the first pixel power source via the fifth transistor T5, and a second electrode thereof may be connected to the anode electrode of the organic light emitting diode OLED via the sixth transistor T6. Further, the gate electrode of the first transistor T1 may be connected to a first node N1. The first transistor T1 may control the amount of current flowing from the first pixel power source ELVDD to the second pixel power source ELVSS via the organic light emitting diode OLED in response to a voltage of the first node N1.

The third transistor T3 may be connected between a second electrode of the first transistor T1 and the first node N1. Further, a gate electrode of the third transistor T3 may be connected to a first scan line S11. The third transistor T3 may be turned on when a scan signal is supplied to the first scan line S11, thereby electrically connecting the second electrode of the first transistor T1 and the first node N1. Accordingly, when the third transistor T3 is turned on, the first transistor T1 may be connected in a form of a diode.

The fourth transistor T4 may be connected between the first node N1 and the third pixel power source Vint. Further, a gate electrode of the fourth transistor T4 may be connected to a scan line S10. The fourth transistor T4 is turned on when a scan signal is supplied to the scan line S10, thereby supplying a voltage of the third pixel power source Vint to the first node N1.

The second transistor T2 may be connected between the first data line D11 and the first transistor T1. Further, a gate electrode of the second transistor T2 may be connected to the first scan line S11. The second transistor T2 may be turned on when a scan signal is supplied to the first scan line S11, thereby electrically connecting the first data line D11 and the first electrode of the first transistor T1.

The storage capacitor Cst may be connected between the first pixel power source ELVDD and the first node N1. The storage capacitor Cst may store a data signal and a voltage corresponding to a threshold voltage of the first transistor T1.

Herein, the first electrode of each of the transistors T1, T2, T3, T4, T5, T6, and T7 may be set to any one of a source electrode and a drain electrode, and the second electrode of each of the transistors T1, T2, T3, T4, T5, T6, and T7 may be set to an electrode different from the first electrode. For example, when the first electrode is set to a source electrode, the second electrode may be set to a drain electrode.

Further, FIG. 4B illustrates that the transistors T1, T2, T3, T4, T5, T6, and T7 are PMOS transistors as an example, but in another exemplary embodiment, the transistors T1, T2, T3, T4, T5, T6, and T7 may be implemented by NMOS transistors.

The pixel structures of FIGS. 4A and 4B are simply the embodiments of the present disclosure, and the pixels PXL and PXL' of the present disclosure are not limited to the pixel structure. Actually, the pixels PXL and PXL' has a circuit structure which is capable of supplying a current to the organic light emitting diode OLED, and any one of the currently published various structures may be selected.

The first pixel power source ELVDD may be a high potential power source, and the second pixel power source ELVSS may be a low potential power source.

For example, the first pixel power source ELVDD may be set to a positive voltage, and the second pixel power source ELVSS may be set to a negative voltage or a ground voltage.

Figure 5:
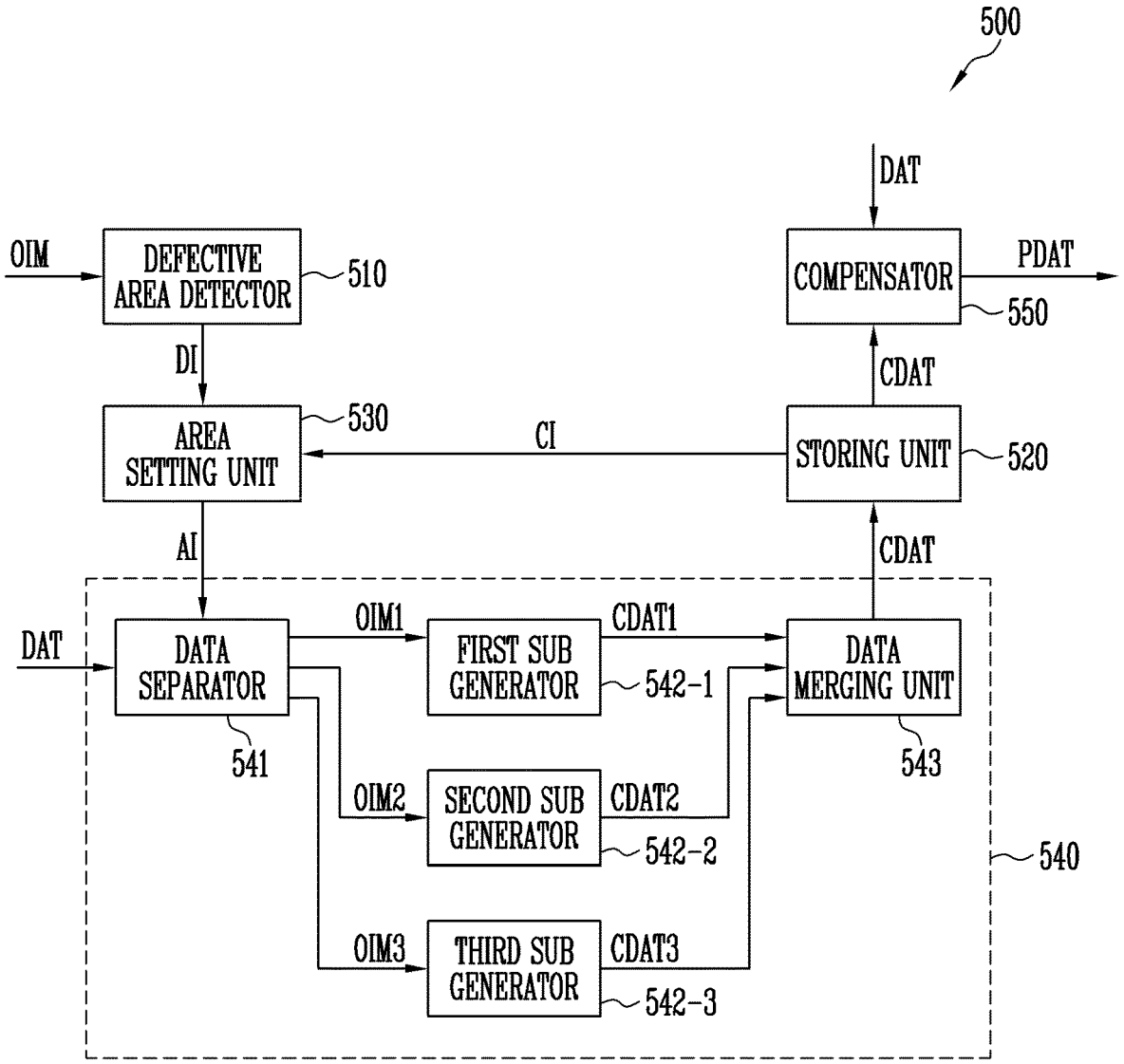
FIG. 5 is a block diagram illustrating a data compensating unit according to the exemplary embodiment of the present disclosure in detail.
Figure 6A:
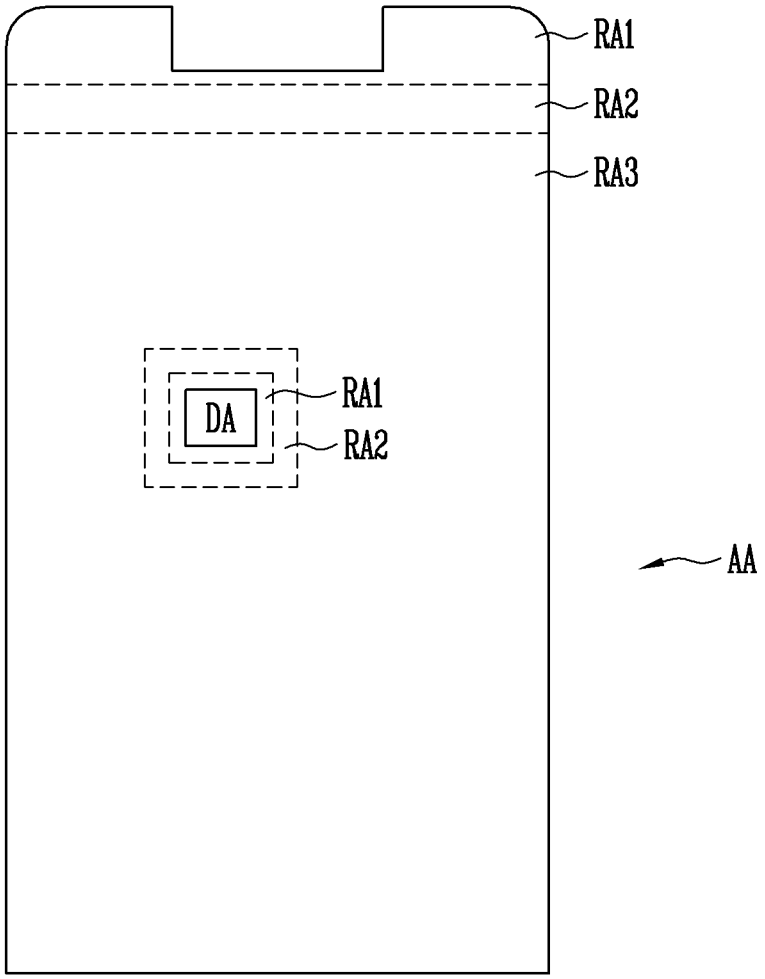
FIGS. 6A and 6B are diagrams illustrating a method of operating a display device according to an exemplary embodiment of the present disclosure.
Figure 6B:
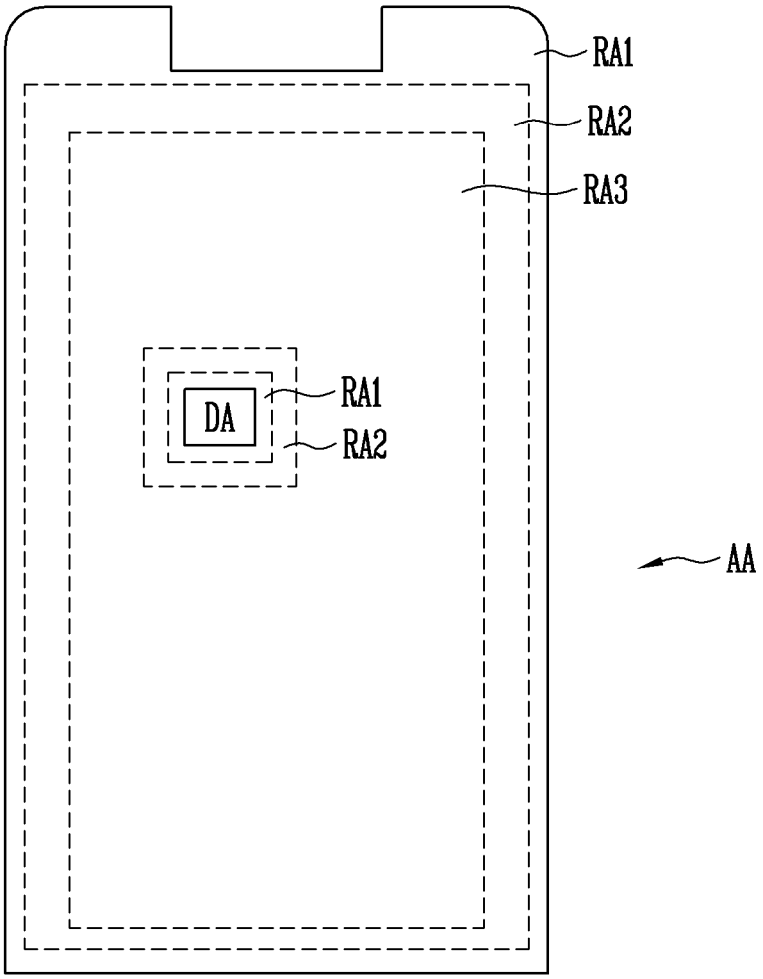

FIG. 5 is a block diagram illustrating the data compensating unit according to the exemplary embodiment of the present disclosure in detail. FIGS. 6A and 6B are diagrams illustrating a method of operating a display device according to an exemplary embodiment of the present disclosure.

Referring to FIGS. 5, 6A, and 6B, the data compensating unit 500 may include a defective area detector 510, a storing unit 520, an area setting unit 530, a compensation data generator 540, and a compensator 550.

The defective area detector 510 may receive the brightness image OIM. The defective area detector 510 may detect a defective area DA based on the brightness image OIM. The defective area detector 510 may generate defect information DI.

The defect information may include information on position coordinates of a pixel (that is, a defective pixel) positioned in the defective area DA.

The defective area DA may mean an area in which at least one defective pixel is positioned. Further, the defective pixel may mean a pixel which emits light with higher or lower brightness, which is visually identifiable, than that of a normal pixel when substantially the same data signal is supplied.

The storing unit 520 may store compensation information CI.

The compensation information CI may include information on position coordinates of the pixels (that is, the second pixels PXL3 and the third pixels PXL3) positioned in the second pixel area AA2 and the third pixel area AA3. For example, the compensation information CI may information pre-stored in the storing unit 520.

Although not illustrated in FIG. 5, the storing unit 520 may store the detective information DI transmitted from the defective area detector 510.

The area setting unit 530 may set different compensation areas based on the compensation information CI and the defect information DI.

For example, the area setting unit 530 may set a first compensation area RA1, a second compensation area RA2, and a third compensation area RA3.

According to the exemplary embodiment, the area setting unit 530 may set the first compensation area RA1, the second compensation area RA2, and the third compensation area RA3 like the exemplary embodiments illustrated in FIGS. 6A and 6B. However, the present disclosure is not limited thereto, and the area setting unit 530 may set different compensation areas.

The first compensation area RA1 may include the second pixel area AA2 and the third pixel area AA3. However, the present disclosure is not limited thereto, and according to the exemplary embodiment, the first compensation area RA1 may include the defective area DA, the second pixel area AA2, and the third pixel area AA3.

An area except for the first compensation area RA1 in the pixel area AA may include the second compensation area RA2.

The third compensation area RA3 may be positioned between the first compensation area RA1 and the second compensation area RA2.

According to the exemplary embodiment, the first compensation area RA1 may have a form entirely or partially surrounding the second compensation area RA2.

The area setting unit 530 may generate area information AI and transmit the generated area information AI to the compensation data generator 540.

The area information AI may include information on the positions of the first compensation area RA1, the second compensation area RA2, and the third compensation area RA3.

The compensation data generator 540 may receive the brightness image OIM and the area information AI.

The compensation data generator 540 may generate compensation data CDAT based on the brightness image OIM and the area information AI.

For example, the compensation data generator 540 may perform comparison processing on the brightness image corresponding to the compensation areas on the different block unit basis and generate compensation data CDAT.

The compensation data generator 540 may include a data separator 541, first to third sub generators 542-1, 542-2, and 542-3, and a data merging unit 543.

The data separator 541 may separate the brightness image OIM into a first sub image OIM1, a second sub image OIM2, and a third sub image OIM3 according to the area information AI.

The first sub image OIM1 may correspond to the first compensation area RA1, the second sub image OIM2 may correspond to the second compensation area RA2, and the third sub image OIM may correspond to the third compensation area RA3.

The data separator 541 may transmit the first sub image OIM1 to the first sub generator 542-1, transmit the second sub image OIM2 to the second sub generator 542-2, and transmit the third sub image OIM3 to the third sub generator 542-3.

The first sub generator 542-1 may perform comparison processing on the first sub image OIM1 on the first block unit basis and generate first sub data CDAT1. For example, the first block may be formed of one pixel.

The second sub generator 542-2 may perform comparison processing on the second sub image OIM2 on the second block unit basis and generate second sub data CDAT2. For example, the second block may be larger than the first block. According to the exemplary embodiment, the second block may be formed of five or more pixels.

The third sub generator 542-3 may perform comparison processing on the third sub image OIM3 on the third block unit basis and generate third sub data CDAT3. For example, the third block may be larger than the first block and may be smaller than the second block. According to the exemplary embodiment, the third block may be formed of two or more and four or less pixels.

The data merging unit 543 may merge the first sub data CDAT1, the second sub data CDAT2, and the third sub data CDAT3, and generate compensation data CDAT.

However, the present disclosure is not limited thereto, and according to the exemplary embodiment, the compensation data generator 540 may include two sub generators or four or more sub generators.

The storing unit 520 may store the compensation data CDAT. For example, the storing unit 520 may be a flash memory.

The compensator 550 may receive the image data DAT and the compensation data CDAT.

The compensator 550 may compensate for the image data DAT based on the compensation data CDAT and generate pixel data PDAT.

For example, the compensator 550 may add the compensation data CDAT to the image data DAT to generate pixel data PDAT.

Figure 7A:
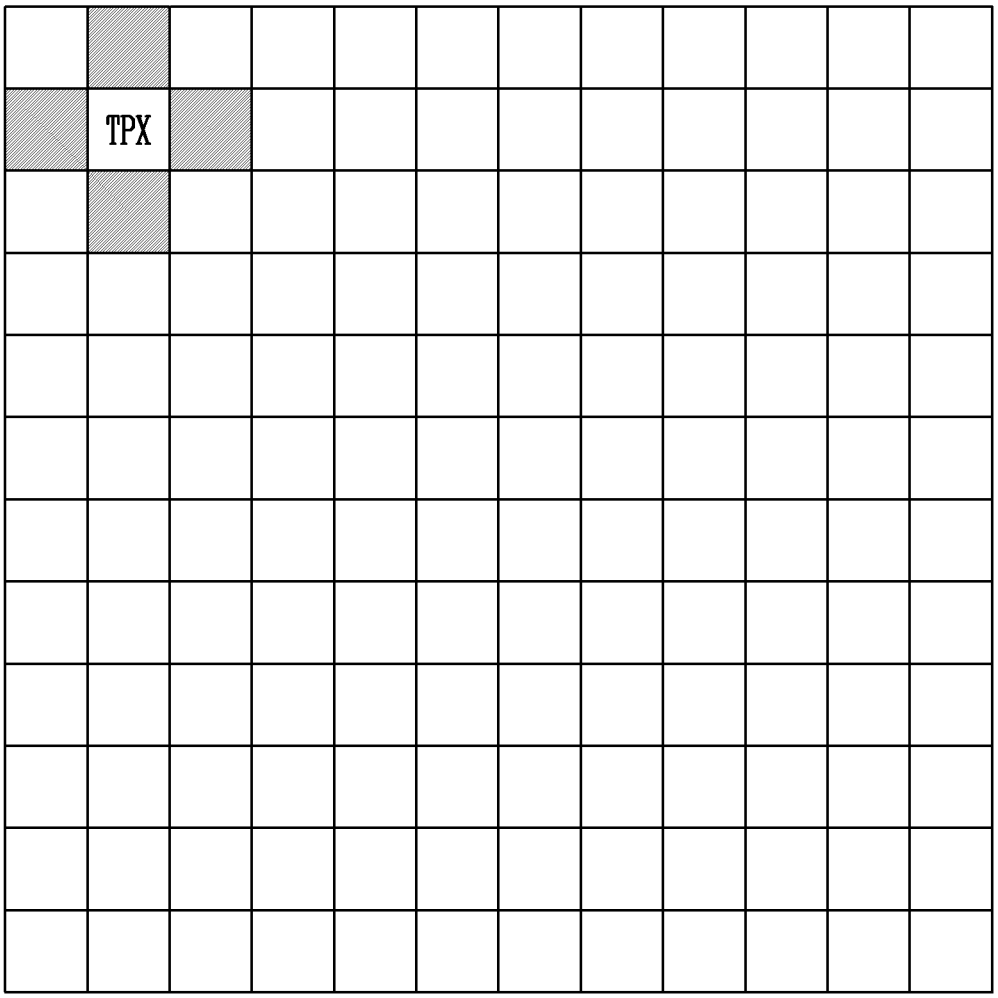
FIGS. 7A to 7C are diagrams illustrating the method of operating the display device according to the exemplary embodiment of the present disclosure.
Figure 7B:
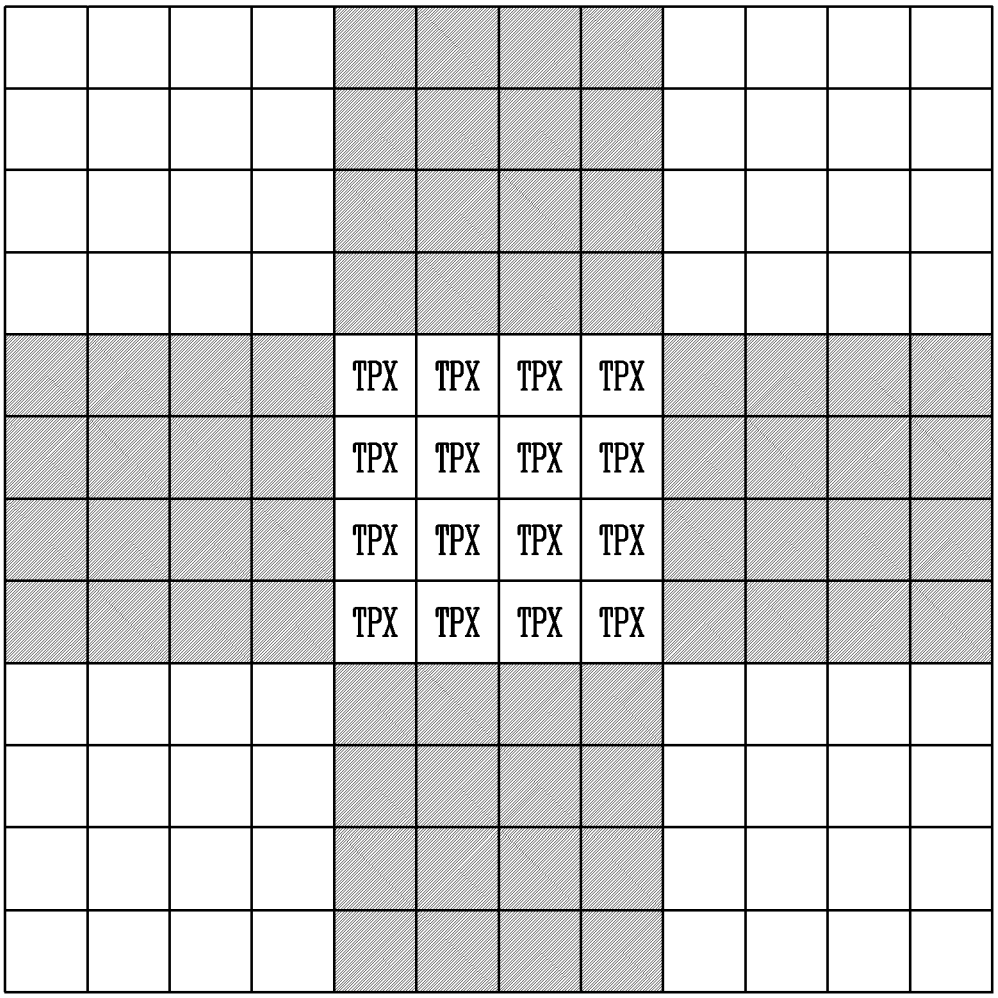
Figure 7C:
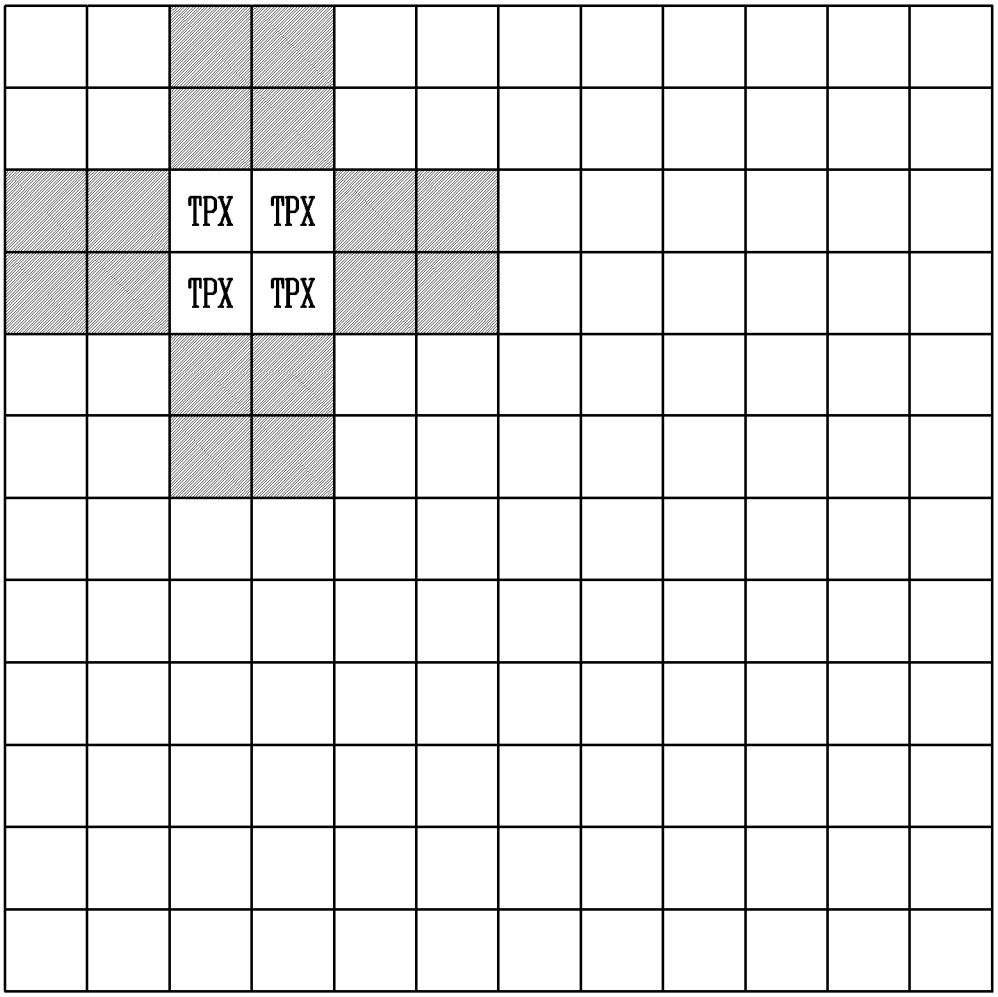

FIGS. 7A to 7C are diagrams illustrating the method of operating the display device according to the exemplary embodiment of the present disclosure.

Referring to FIGS. 5 and 7A, the first sub generator 542-1 may receive the first sub image OIM1.

The first sub generator 542-1 may set some of the pixels of the first sub image OIM1 as target pixels TPX on the first block unit basis.

FIG. 7A illustrates the case where the first block is formed of 1×1 pixel. However, the present disclosure is not limited thereto.

The first sub generator 542-1 may compare a brightness value of the target pixel TPX with an average value of brightness values of peripheral pixels and calculate a difference value.

The first sub generator 542-1 may generate the first sub data CDAT1 based on the calculated difference value.

Referring to FIGS. 5 and 7B, the second sub generator 542-2 may receive the second sub image OIM2.

The second sub generator 542-2 may set some of the pixels of the second sub image OIM2 as target pixels TPX on the second block unit basis.

FIG. 7B illustrates the case where the second block is formed of 4×4 pixels. However, the present disclosure is not limited thereto.

The second sub generator 542-2 may compare an average value of brightness values of the target pixels TPX with an average value of brightness values of peripheral pixels and calculate a difference value.

The second sub generator 542-2 may generate the second sub data CDAT2 based on the calculated difference value.

Referring to FIGS. 5 and 7C, the third sub generator 542-3 may receive the third sub image OIM3.

The third sub generator 542-3 may set some of the pixels of the third sub image OIM3 as target pixels TPX on the third block unit basis.

FIG. 7C illustrates the case where the third block is formed of 2×2 pixel. However, the present disclosure is not limited thereto.

The third sub generator 542-3 may compare an average value of brightness values of the target pixels TPX with an average value of brightness values of peripheral pixels and calculate a difference value.

The third sub generator 542-3 may generate the third sub data CDAT3 based on the calculated difference value.

Figure 8:
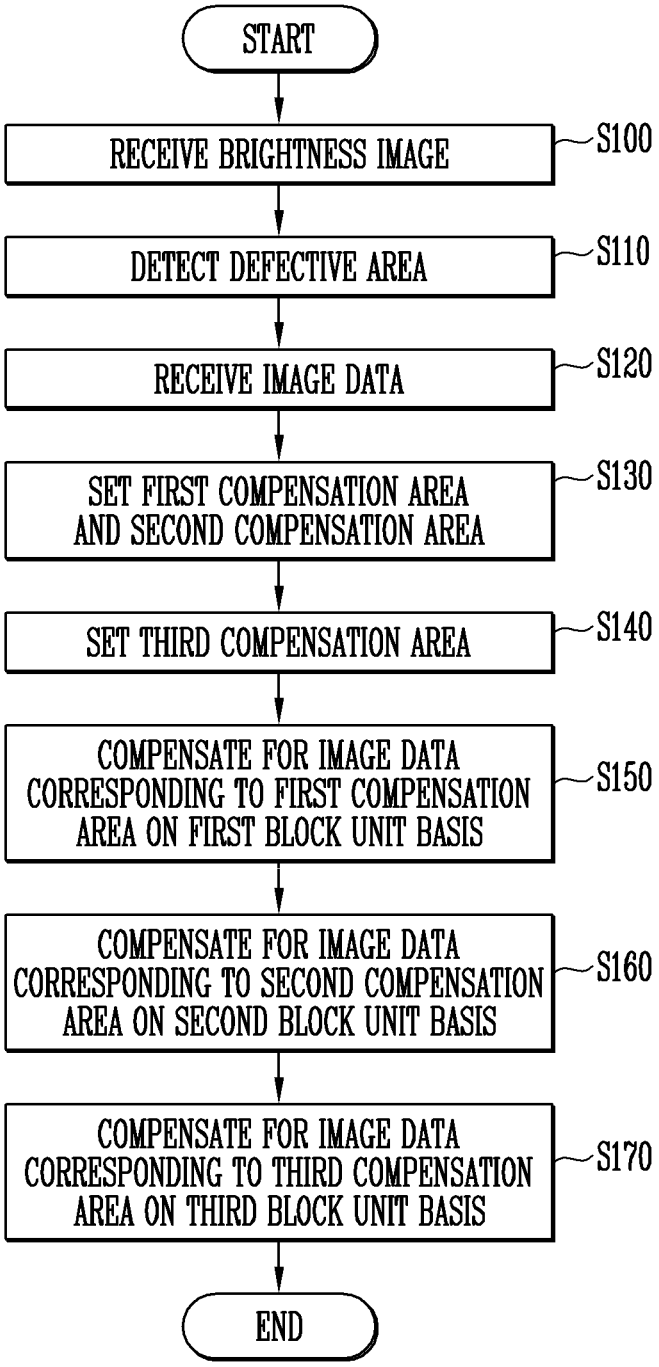
FIG. 8 is a flowchart illustrating the method of operating the display device according to the exemplary embodiment of the present disclosure.

FIG. 8 is a flowchart illustrating the method of operating the display device according to the exemplary embodiment of the present disclosure.

The method of operating the display device according to the exemplary embodiment of the present disclosure will be described below with reference to FIGS. 1, 3, 5, and 8.

In operation S100, the display device 10 may receive a brightness image OIM.

The data compensating unit 500 may receive a brightness image OIM obtained from an external photographing camera (not illustrated). For example, the brightness image OIM may be obtained by photographing, by the external photographing camera (not illustrated), the pixel areas AA1, AA2, and AA3 displaying a basic image.

In operation S110, the display device 10 may detect a defective area DA based on the brightness image OIM.

The defective area detector 510 of the display device 10 may detect a defective area DA based on the brightness image OIM. The defective area detector 510 may generate defect information DI.

In operation S120, the display device 10 may receive image data DAT.

The data compensating unit 500 of the display device 10 may receive image data DAT.

In operation S130, the display device 10 may set a first compensation area RA1 and a second compensation area RA2.

In operation S140, the display device 10 may further set a third compensation area RA3.

The area setting unit 530 of the display device 10 may set different compensation areas based on the compensation information CI and the defect information DI.

The area setting unit 530 may generate area information AI. In this case, the area information AI may include information on the positions of the first compensation area RA1, the second compensation area RA2, and the third compensation area RA3.

In operation S150, the display device 10 may compensate for the image data DAT corresponding to the first compensation area RA1 on the first block unit basis.

In operation S160, the display device 10 may compensate for the image data DAT corresponding to the second compensation area RA2 on the second block unit basis.

In operation S170, the display device 10 may compensate for the image data DAT corresponding to the third compensation area RA3 on the third block unit basis.

The compensation data generator 540 of the display device 10 may perform comparison processing on the brightness images corresponding to the compensation areas in the different block unit basis and generate compensation data CDAT.

The compensator 550 of the display device 10 may receive the image data DAT and the compensation data CDAT and compensate for the image data DAT based on the compensation data CDAT. For example, the compensator 550 may add the compensation data CDAT to the image data DAT to generate pixel data PDAT.

It will be understood by those skilled in the art that various changes in a specific form and details may be made therein without the change of the technical spirit or the essential features of the present invention. Thus, it is to be appreciated that the embodiments described above are intended to be illustrative in every sense, and not restrictive. The scope of the present disclosure is represented by the scope of the claims described below rather than the detailed description, and it shall be construed that all of the changes or modified forms derived from the meanings and the scope of the claims, and the equivalent concept thereof are included in the scope of the present disclosure.

What is claimed is:

1. A display device, comprising:

first pixels in a first pixel area;

second pixels in a second pixel area that has a different width from a width of the first pixel area; and a data compensating unit configured to compensate image data, wherein the data compensating unit is configured to set a first compensation area and a second compensation area that is different from the first compensation area, and to compensate the image data corresponding to the first compensation area on a first block unit basis, and to compensate the image data corresponding to the second compensation area on a second block unit basis that is different from the first block unit basis, and the first compensation area comprises the second pixel area.

2. The display device of claim 1, wherein the data compensating unit is configured to detect a defective area in which at least one defective pixel is positioned based on a brightness image, and the first compensation area further comprises the defective area.

3. The display device of claim 2, wherein the data compensating unit comprises:

a defective area detector configured to generate defect information comprising information on position coordinates of the defective pixel based on the brightness image;

a storing unit configured to store compensation information comprising information on position coordinates of the second pixels; and an area setting unit configured to set the first compensation area and the second compensation area based on the defect information and the compensation information, and generate area information about positions of the first compensation area and the second compensation area.

4. The display device of claim 3, wherein the data compensating unit further comprises:

a compensation data generator configured to generate compensation data based on the brightness image and the area information; and a compensator configured to compensate the image data based on the compensation data.

5. The display device of claim 4, wherein the compensation data generator comprises:

a data separator configured to separate the brightness image into a first sub image corresponding to the first compensation area and a second sub image corresponding to the second compensation area based on the area information;

a first sub generator configured to perform comparison processing on the first sub image on the first block unit basis to generate first sub data;

a second sub generator configured to perform comparison processing on the second sub image on the second block unit basis to generate second sub data; and a data merging unit configured to merge the first sub data and the second sub data and to generate the compensation data.

6. The display device of claim 2, wherein the defective pixel emits light having higher or lower brightness than brightness of a normal pixel when the same data signal is supplied.

7. The display device of claim 1, wherein the data compensating unit is further configured to set a third compensation area that is different from the first compensation area and the second compensation area, and the third compensation area is between the first compensation area and the second compensation area.

8. The display device of claim 7, wherein the data compensating unit is configured to compensate the image data corresponding to the third compensation area on a third block unit basis, and the number of pixels included in the third block unit is less than the number of pixels included in the second block unit and is greater than the number of pixels included in the first block unit.

9. The display device of claim 8, wherein the number of pixels included in the first block unit is one, the number of pixels included in the second block unit is five or more, and the number of pixels included in the third block unit is two or more and four or less.

10. The display device of claim 1, wherein the width of the first pixel area is larger than the width of the second pixel area.

11. The display device of claim 1, wherein the number of pixels included in the first block unit is less than the number of pixels included in the second block unit.

12. The display device of claim 1, wherein the second pixel area is positioned at one side of the first pixel area.

13. The display device of claim 1, further comprising:

third pixels positioned in a third pixel area having a different width from the width of the first pixel area, the second pixel area is spaced apart from the third pixel area.

14. The display device of claim 1, wherein the first compensation area entirely surrounds the second compensation area.

15. The display device of claim 1, wherein the first compensation area partially surrounds the second compensation area.

16. A method of operating a display device, which comprises first pixels in a first pixel area, second pixels in a second pixel area having a different width from a width of the first pixel area, and a data compensating unit configured to compensate image data, the method comprising:

receiving the image data;

setting a first compensation area and a second compensation area that is different from the first compensation area;

compensating the image data corresponding to the first compensation area on a first block unit basis; and compensating for the image data corresponding to the second compensation area on a second block unit basis that is different from the first block unit basis, wherein the first compensation area includes the second pixel area.

17. The method of claim 16, further comprising:

setting a third compensation area that is different from the first compensation area and the second compensation area, wherein the third compensation area is positioned between the first compensation area and the second compensation area.

18. The method of claim 17, further comprising:

compensating for the image data corresponding to the third compensation area on a third block unit basis, wherein the number of pixels included in the third block unit is less than the number of pixels included in the second block unit and is greater than the number of pixels included in the first block unit.

19. The method of claim 16, further comprising:

receiving a brightness image; and detecting a defective area in which at least one defective pixel is positioned based on a brightness image, wherein the first compensation area further comprises the defective area.

* * * * *